US011385028B1

(12) United States Patent
LeMarbe

(10) Patent No.: US 11,385,028 B1
(45) Date of Patent: Jul. 12, 2022

(54) REMOVABLE AND STOWABLE THROAT GUARD

(71) Applicant: Point Blank Enterprises, Inc., Pompano Beach, FL (US)

(72) Inventor: Randall J. LeMarbe, Pompano Beach, FL (US)

(73) Assignee: POINT BLANK ENTERPRISES, INC., Pompano Beach, FL (US)

( * ) Notice: Subject to any disclaimer, the term of this patent is extended or adjusted under 35 U.S.C. 154(b) by 0 days.

(21) Appl. No.: 17/405,306

(22) Filed: Aug. 18, 2021

Related U.S. Application Data

(60) Provisional application No. 63/184,603, filed on May 5, 2021.

(51) Int. Cl.
*F41H 1/02* (2006.01)
*A41D 13/00* (2006.01)

(52) U.S. Cl.
CPC ..... *F41H 1/02* (2013.01); *A41D 13/0005* (2013.01)

(58) Field of Classification Search
CPC ..... F41H 1/02; A41D 13/0005
USPC ..... 2/468
See application file for complete search history.

(56) References Cited

U.S. PATENT DOCUMENTS 1,298,618 A * 3/1919 Wloszek ..... F41H 1/02 2/2.5
4,449,251 A * 5/1984 Gauthier ..... A41D 13/0512 2/468
4,686,710 A * 8/1987 Marston ..... A41D 13/0512 2/2.5
4,881,529 A * 11/1989 Santos ..... A41D 13/0512 2/415
5,970,513 A * 10/1999 Kocher ..... F41H 1/02 2/2.5
6,098,196 A * 8/2000 Logan ..... F41H 1/02 2/2.5
6,163,891 A * 12/2000 Viitalahti ..... A42B 3/105 2/468
6,934,970 B1 * 8/2005 Watkins ..... A41D 13/0512 2/96
2004/0078877 A1 * 4/2004 Harty ..... A41D 13/0512 2/468
2011/0010829 A1 * 1/2011 Norman ..... A41D 13/0512 2/463
2013/0232654 A1 * 9/2013 Camillo ..... A41D 13/0512 2/2.5
2016/0138894 A1 * 5/2016 Heise ..... F41H 5/0457 89/36.05
2016/0158630 A1 * 6/2016 Stiles ..... A63B 71/1291 2/468

* cited by examiner

*Primary Examiner* — Tajash D Patel
(74) *Attorney, Agent, or Firm* — Geoffrey Lottenberg; Berger Singerman LLP

(57) ABSTRACT

A throat guard has one or more insertion points which are received in openings or otherwise removably attached to a garment component. The insertion points can be upper horns and a lower section with the upper horns received in openings on the collar of the garment component and the lower section is received a central opening of the garment component. In an undeployed position the upper horns are released from collar of the garment component, but the throat guard remains attached to the garment component and available to be quickly secured around the throat area of the wearer.

8 Claims, 6 Drawing Sheets

REMOVABLE AND STOWABLE THROAT GUARD

CROSS REFERENCE TO RELATED APPLICATIONS

This application claims the benefit of U.S. Provisional Application No. 63/184,603 filed on May 5, 2021.

It will be recognized that some or all of the Figures are schematic representations for purposes of illustration and do not necessarily depict the actual relative sizes or locations of the elements shown. The Figures are provided for the purpose of illustrating one or more embodiments of the invention with the explicit understanding that they will not be used to limit the scope or the meaning of the claims.

DETAILED DESCRIPTION OF THE INVENTION

In the following description, for the purposes of explanation, numerous specific details are set forth in order to provide a thorough understanding of the invention of the present invention. It will be apparent, however, to one skilled in the art that the invention may be practiced without some of these specific details. Throughout this description, the embodiments and examples shown should be considered as exemplars, rather than as limitations on the invention. That is, the following description provides examples, and the accompanying drawings show various examples for the purposes of illustration. However, these examples should not be construed in a limiting sense as they are merely intended to provide examples of the invention rather than to provide an exhaustive list of all possible implementations of the invention.

Specific embodiments of the invention will now be further described by the following, non-limiting examples which will serve to illustrate various features. The examples are intended merely to facilitate an understanding of ways in which the invention may be practiced and to further enable those of skill in the art to practice the invention. Accordingly, the examples should not be construed as limiting the scope of the invention. In addition, reference throughout this specification to "one embodiment" or "an embodiment" means that a particular feature, structure or characteristic described in connection with the embodiment is included in at least one embodiment of the present invention. Thus, appearances of the phrases "in one embodiment" or "in an embodiment" in various places throughout this specification are not necessarily all referring to the same embodiment.

Furthermore, the particular features, structures or characteristics may be combined in any suitable manner in one or more embodiments.

Figure 1:
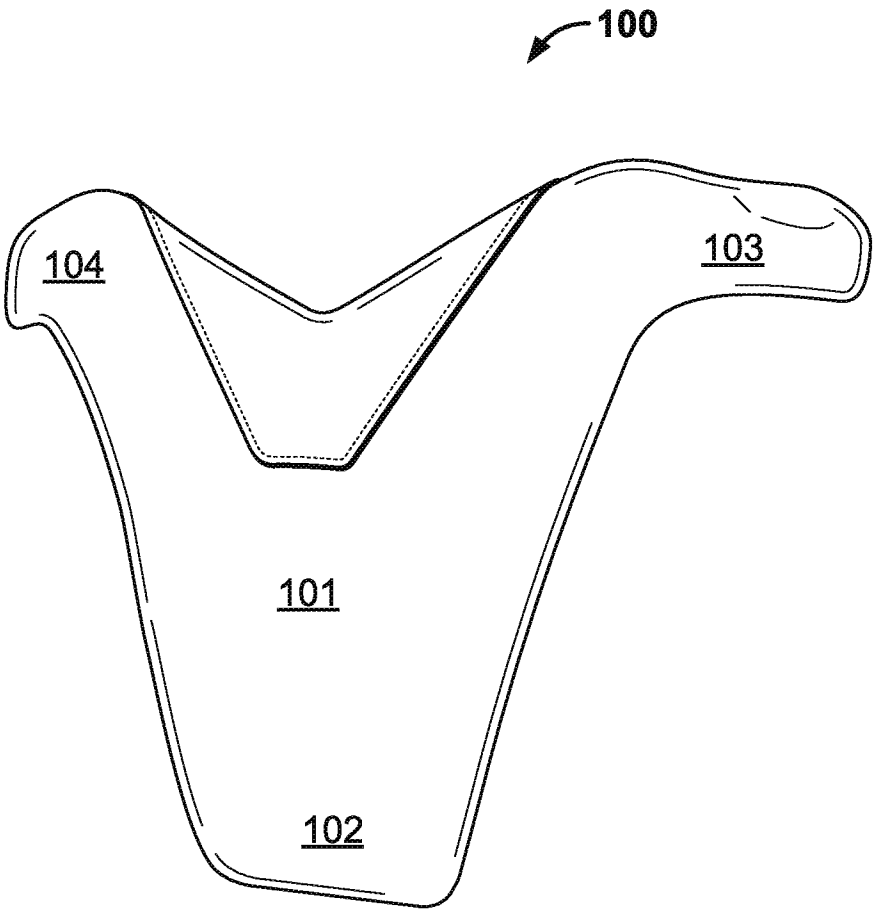
FIG. 1 is a perspective view of the throat guard in isolation.

With reference to FIG. 1, shown is an embodiment of a deployable throat guard 100 having a body-conforming surface 101 and configured in a generally Y-shaped configuration delimiting one or more insertion points. In some embodiments, the insertion points comprise a lower section 102 and bi-lateral upper horns 103 and 104 and the respective upper corners of the protector 100. The throat guard 100 can comprise ballistic armor or may include an opening to receive removable ballistic armor.

Figure 2:
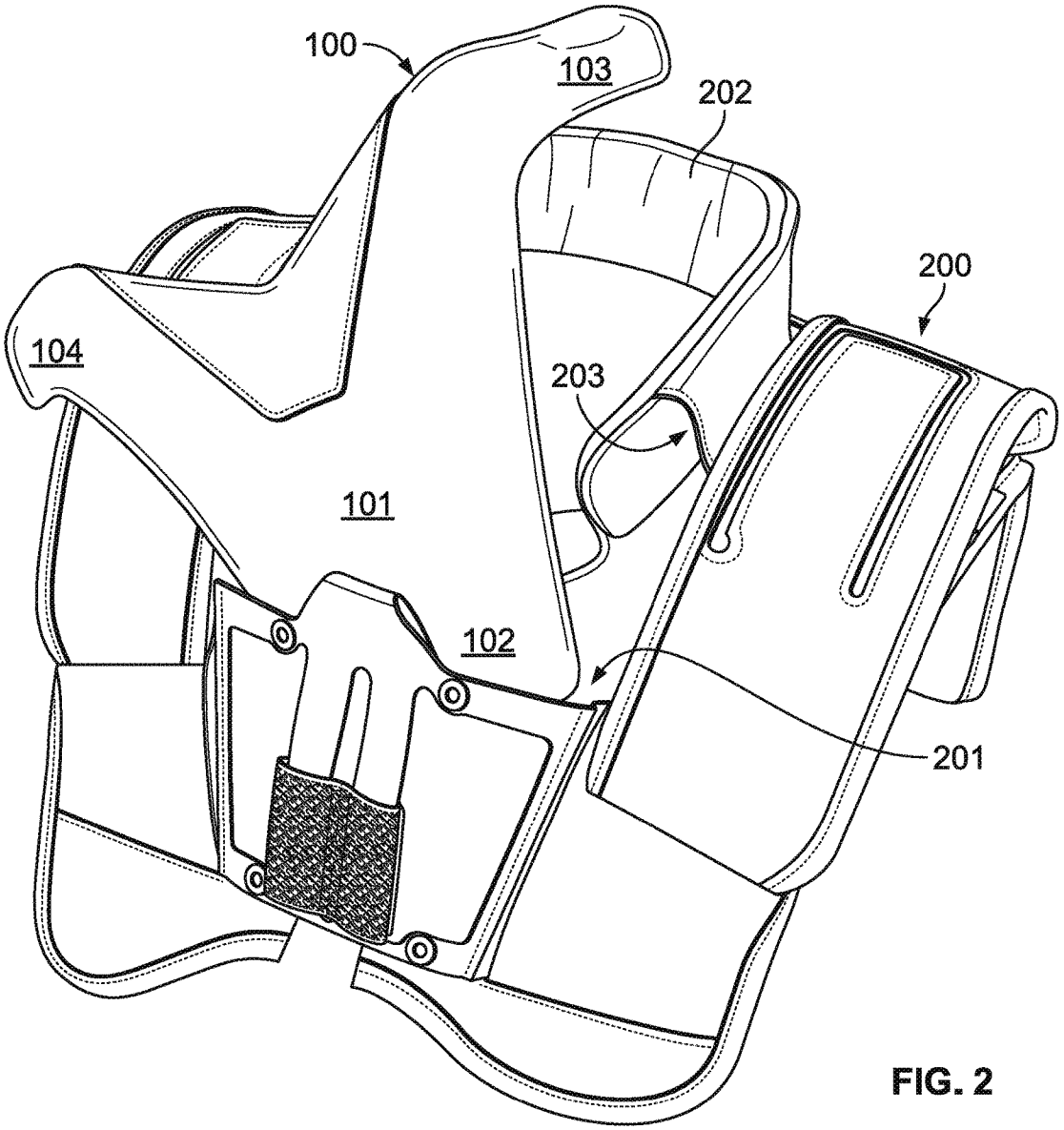
FIG. 2 is a perspective view of the throat guard at a first step of insertion into a garment component.
Figure 3:
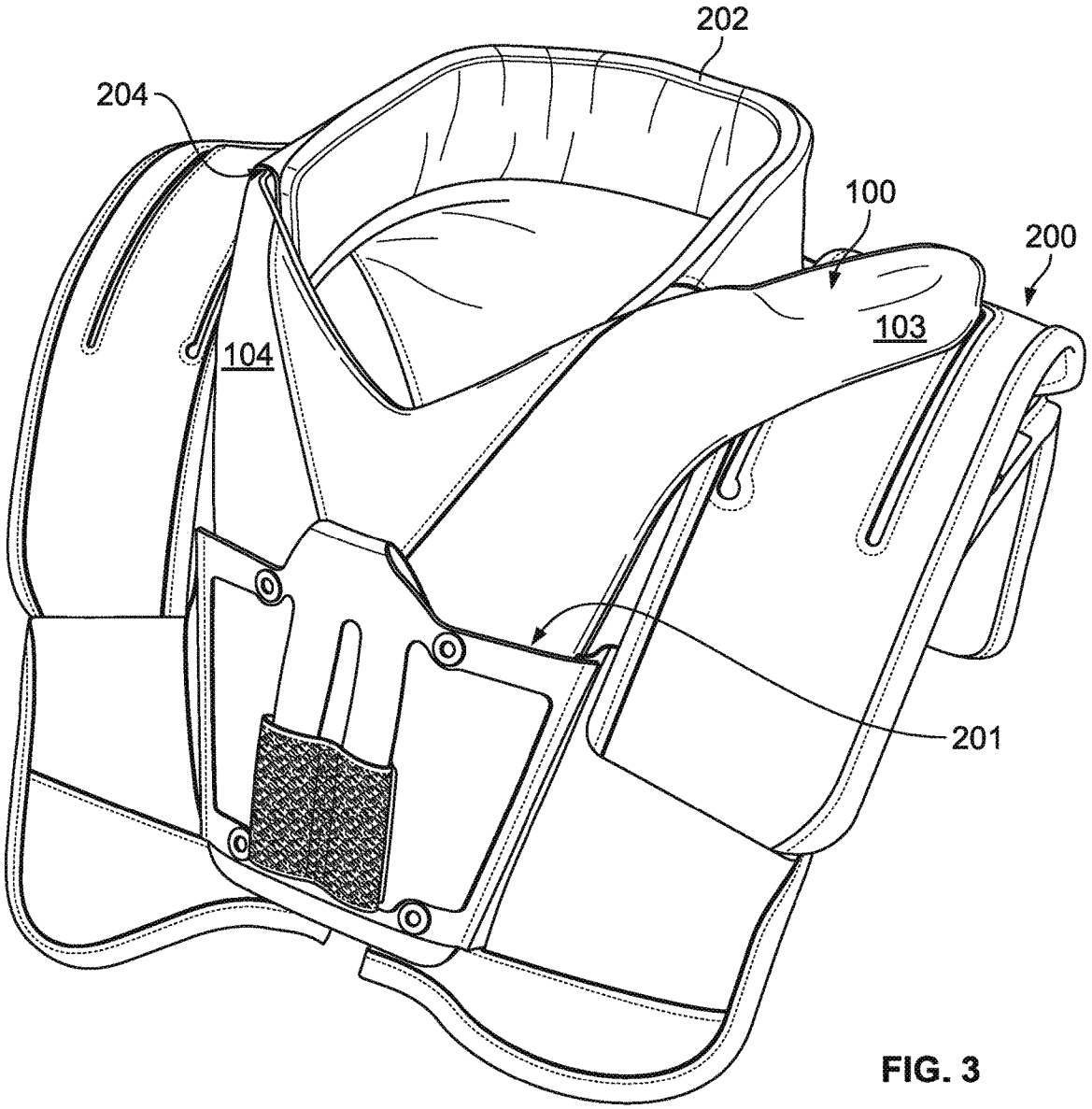
FIG. 3 is a perspective view of the throat guard at a second step of insertion into a garment component.

With reference to FIG. 2 shown is an embodiment of a garment component 200 configured as an upper body yolk or protector. The garment component 200 is disposed over the shoulders and provides protection for the upper shoulders and neck area of the wearer. In some embodiments, the garment component 200 provides structure to comfortably retain the weight of a body armor carrier or other garment across the shoulders and upper body of the wearer. In some embodiments, the garment component comprises combinations of soft and hard armor to provide protection against blunt objects, sharp objects, ballistics, and fragmentation.

Figure 4:
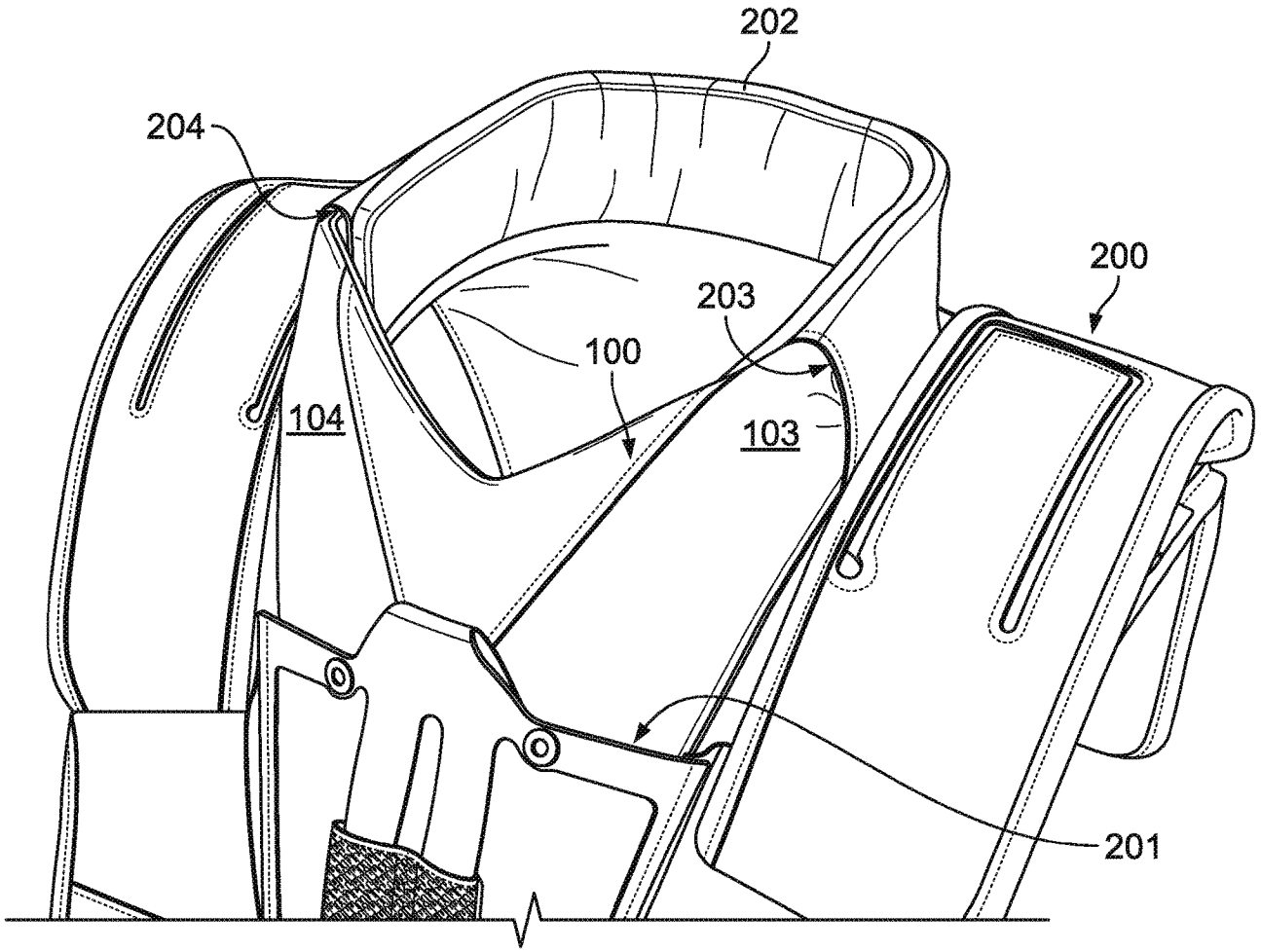
FIG. 4 is a perspective view of the throat guard at a third step of insertion into a garment component.

With reference to FIGS. 2-5, shown is the arrangement of the throat guard 100 with respect to the garment component 200. In some embodiments, the two upper horns 103 and 104 are received in corresponding openings 203 and 204 on the collar 202 of the garment component 200. The lower section 102 of the throat guard 100 is received into a central opening 201 of the garment component 200. In some embodiments, in sequence, the lower section 102 is inserted first, and then the respective upper horns 103 and 104 are inserted into the corresponding openings 203 and 204 of the collar 202. FIG. 4 shows the throat guard 100 in its fully installed position relative to the garment component 200. It is appreciated that the upper horns and/or lower section of the throat guard 100 can be received in other openings of the garment component 200 or can otherwise be removably attached thereto by fasteners such as snap, hook and loop fastener, or the like.

Figure 5:
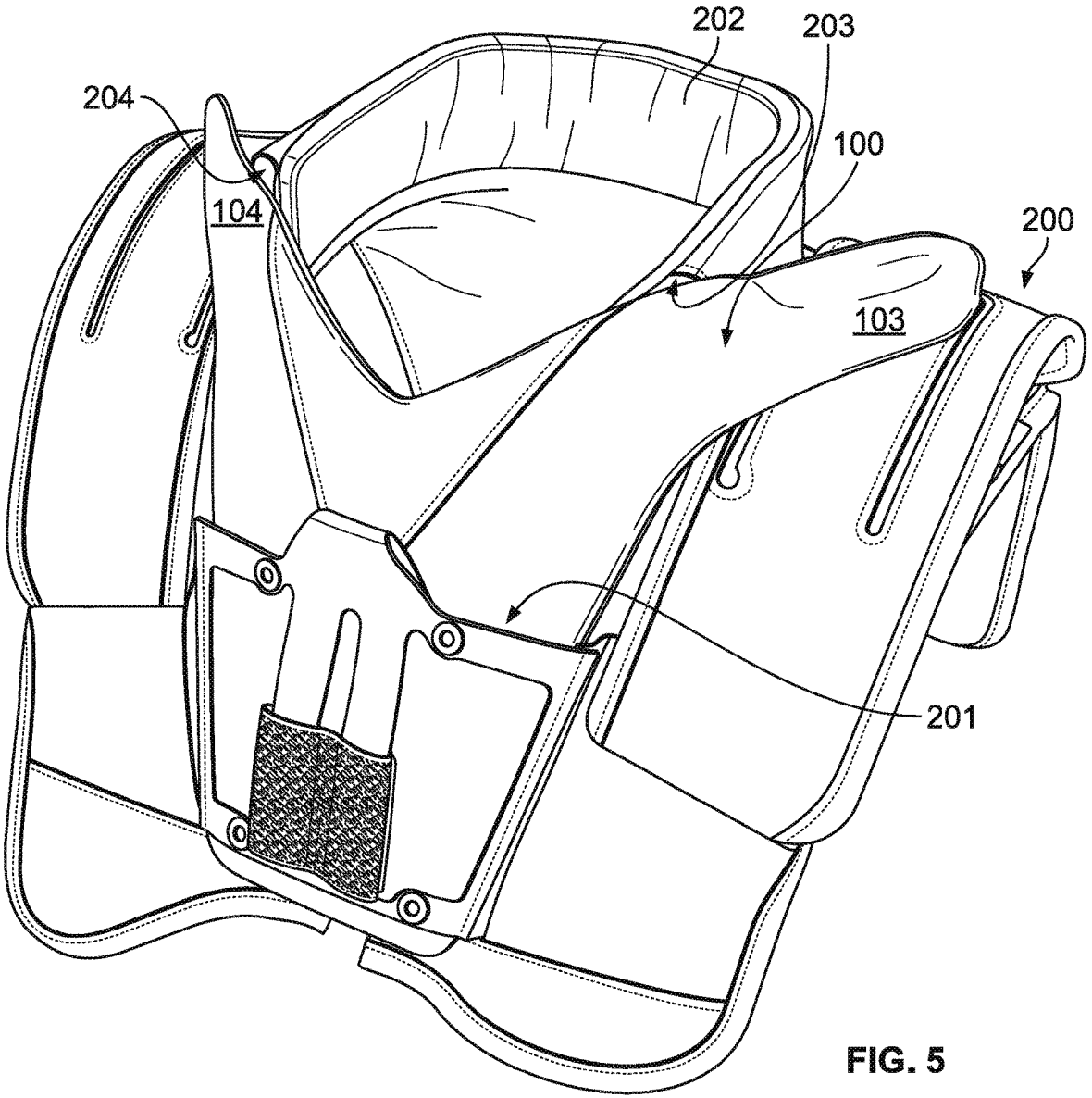
FIG. 5 is a perspective view of the throat guard in an undeployed position relative to the garment component.
Figure 6:
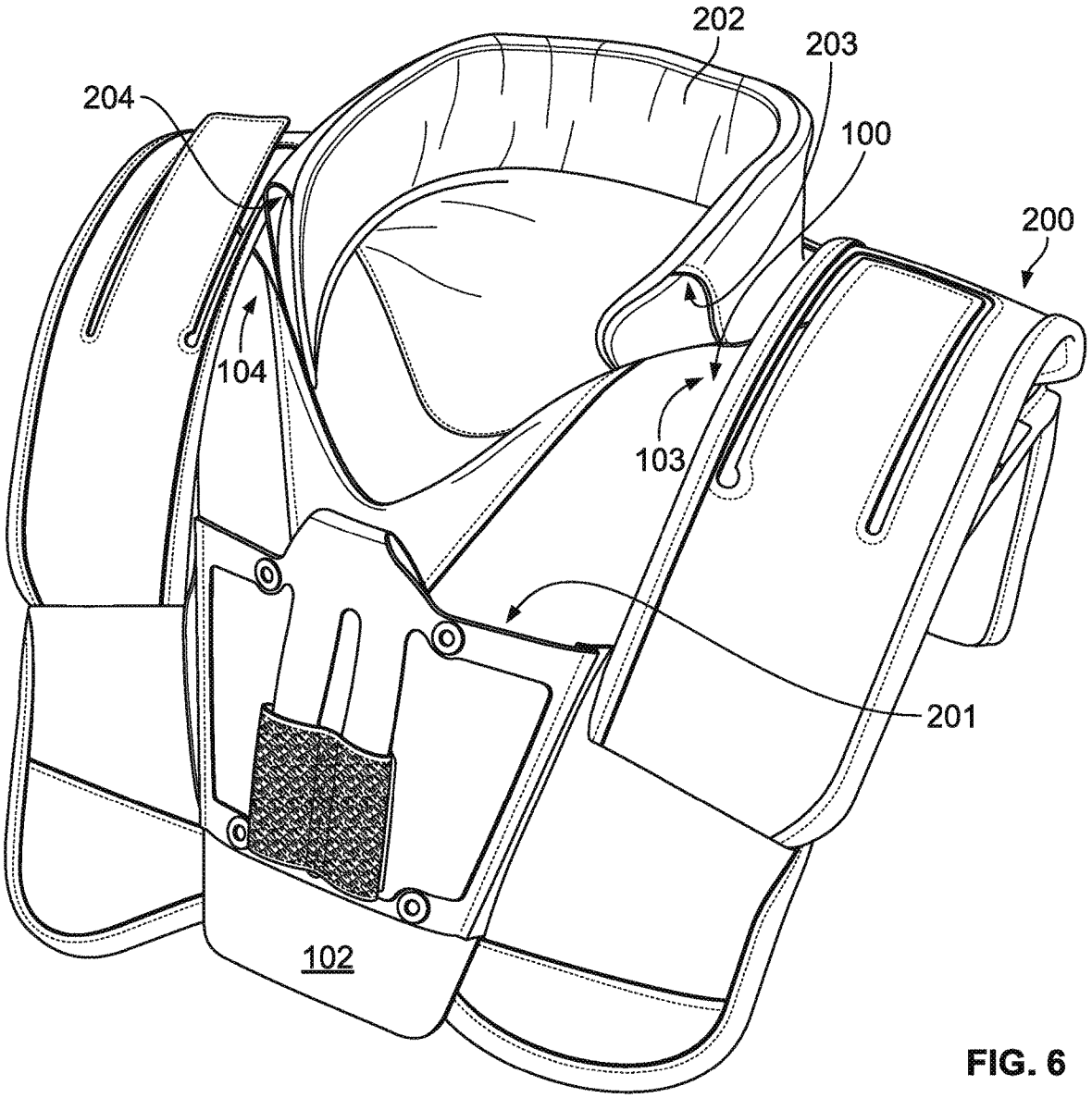
FIG. 6 is a perspective view of the throat guard in an alternative undeployed position relative to the garment component.

With reference, in use, as shown in FIG. 5 the wearer has the option of removing the horns 103 and 104 from the respective openings 203 and 204 on the collar 202, but keep the lower section 102 in the central opening 201 so that the throat guard 100 is retained by the garment component 200 but is generally displaced away from the neck of the wearer. This allows for an "undeployed" position where the wearer does not require or desire throat protection at a given time but has the benefit of keeping the throat guard on the garment component for easy access and re-insertion as needed. This provides enhanced comfort and convenience for the wearer. FIG. 6 shows an alternative "undeployed" position wherein the horns 103 and 104 are tucked under a portion of the garment component 200, for example a layer material at or about the shoulder area thereof. This tucks the horns 103 and 104 away from snagging but provides comfort for the wearer.

It is appreciated and understood that the components described herein can be of a multi-material construction. In some embodiments, the fabrics that face inward toward the wearer or otherwise come in contact with the body of the wearer, such as the collar, are composed of a no-snag pack cloth or nylon material. This avoids snagging on rough skin or facial hair. It is to be noticed that the term "opening" as used herein and in the claims shall be deemed limited as it may refer to any number of slots, slits, apertures, channels, covered areas, or the like. It is to be noticed that the term "comprising," used in the claims, should not be interpreted as being limitative to the means listed thereafter. Thus, the scope of the expression "a device comprising means A and B" should not be limited to devices consisting only of components A and B. It means that with respect to the present invention, the only relevant components of the device are A and B. Put differently, the terms "including", "comprising" and variations thereof mean "including but not limited to", unless expressly specified otherwise.

Similarly, it is to be noticed that the term "coupled", also used in the claims, should not be interpreted as being limitative to direct connections only. Thus, the scope of the expression "a device A coupled to a device B" should not be limited to devices or systems wherein an output of device A is directly connected to an input of device B. It means that there exists a path between an output of A and an input of B which may be a path including other devices or means.

The enumerated listing of items does not imply that any or all of the items are mutually exclusive, unless expressly specified otherwise. The terms "a", "an" and "the" mean "one or more", unless expressly specified otherwise.

Elements of the invention that are in communication with each other need not be in continuous communication with each other, unless expressly specified otherwise. In addition, elements of the invention that are in communication with each other may communicate directly or indirectly through one or more other elements or other intermediaries.

One skilled in the art will appreciate that the present invention can be practiced by other than the above-described embodiments, which are presented in this description for purposes of illustration and not of limitation. The specification and drawings are not intended to limit the exclusionary scope of this patent document. It is noted that various equivalents for the particular embodiments discussed in this description may practice the invention as well. That is, while the present invention has been described in conjunction with specific embodiments, it is evident that any alternatives, modifications, permutations and variations will become apparent to those of ordinary skill in the art in light of the foregoing description. Accordingly, it is intended that the present invention embrace all such alternatives, modifications and variations as fall within the scope of the appended claims. The fact that a product, process or method exhibits differences from one or more of the above-described exemplary embodiments does not mean that the product or process is outside the scope (literal scope and/or other legally-recognized scope) of the following claims.

What is claimed is:

1. A throat guard and garment component arrangement, wherein:

insertion points of the throat guard include a lower section and two upper horns;

the garment component includes one or more openings; and wherein at least one of the lower section and the two upper horns is removably received in one of the openings of the garment component.

2. The throat guard and garment component arrangement of claim 1, wherein the garment component includes a central opening and a collar, the central opening configured to receive the lower section of the throat guard, and the collar including two openings, each configured to receive one of the upper horns of the throat guard.

3. The throat guard and garment component arrangement of claim 2, wherein in an undeployed position the upper horns are each released from the openings of the collar of the garment component.

4. The throat guard and garment component arrangement of claim 1, wherein the throat guard comprises ballistic armor.

5. On a garment component, insertion points of a throat guard include a lower section and two upper horns, at least one of the lower section and the two upper horns configured to be removably received in at least one opening on the garment component.

6. The throat guard of claim 5, wherein the lower section of the throat guard is configured to be removably received in a central opening of the garment component and each of the upper horns are configured to be removably received in an opening on a collar of the garment component.

7. The throat guard of claim 6, wherein in an undeployed position the upper horns are released from the respective openings of the collar of the garment component.

8. The throat guard of claim 7, wherein in the undeployed position the upper horns are tucked under a portion of the garment component.

* * * * *